United States Patent [19]

Aichinger et al.

[11] Patent Number: 4,489,845

[45] Date of Patent: Dec. 25, 1984

[54] SCREW-CAP FOR CONTAINER

[75] Inventors: Dietmar Aichinger, Rünenberg; Hans-Werner Breuer, Himmelried, both of Switzerland

[73] Assignee: Albert Obrist AG, Reinach, Switzerland

[21] Appl. No.: 491,209

[22] Filed: May 3, 1983

[30] Foreign Application Priority Data

May 4, 1982 [CH] Switzerland ..... 2720/82

[51] Int. Cl.[3] ..... B65D 53/00

[52] U.S. Cl. ..... 215/329; 215/341; 215/344; 215/DIG. 1

[58] Field of Search ..... 215/329, 341, 344, DIG. 1

[56] References Cited

U.S. PATENT DOCUMENTS

| | | | |
|---|---|---|---|
| 2,965,256 | 12/1960 | Yochem | 215/329 |
| 3,255,907 | 6/1966 | Eddy | 215/329 |
| 4,143,785 | 3/1979 | Ferrell | 215/DIG. 1 |

FOREIGN PATENT DOCUMENTS

| | | | |
|---|---|---|---|
| 1379189 | 10/1964 | France | 215/329 |
| 2302252 | 9/1976 | France | 215/341 |
| 607702 | 10/1978 | Switzerland | 215/341 |

*Primary Examiner*—Donald F. Norton
*Attorney, Agent, or Firm*—William R. Hinds

[57] ABSTRACT

A screw-cap (1) for closing a container mouth has a sealing lip (5), which is affixed to the cap top (4). The inner side-wall (7) of the sealing lip (5) has a diameter (A) which is greater than the outer diameter (B) of the container outer wall (8). A clamping device, which can be designed as an inner seal (13), creates a contraction of the cap top when the screw-cap is screwed on to the container, by which means the sealing lip (5) is pressed against the container mouth (8). In this manner the sealing lip (5) is only pressed radially against the container mouth during the course of the screwing-on process. In this way over-stretching and damage to the material of the sealing lip can be prevented.

8 Claims, 3 Drawing Figures

SCREW-CAP FOR CONTAINER

Figure 1:
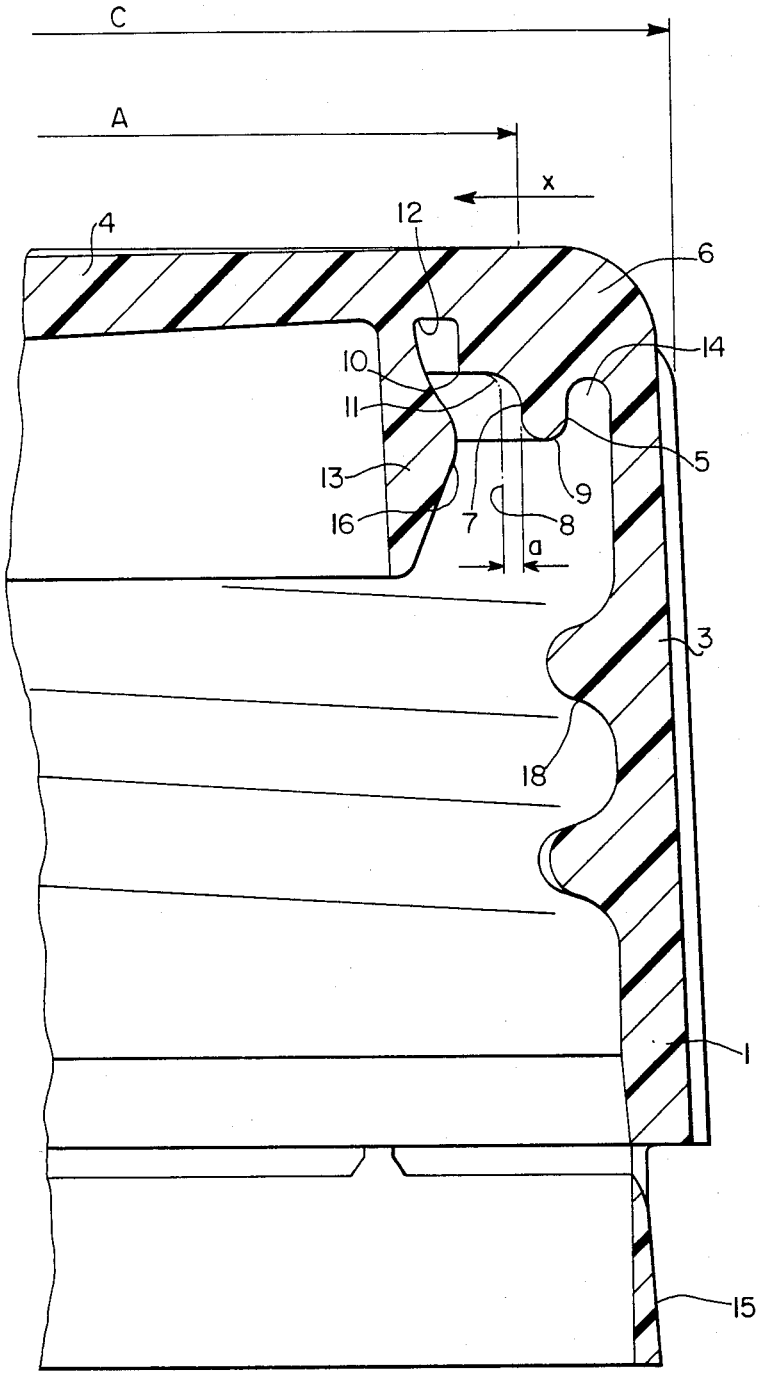

The invention concerns a screw-cap made of plastic material for closing the mouth of a container, consisting of an approximately cylindrical cap side-wall with inner threading and a cap top, which is provided with a ring-shaped sealing lip to seal off the outer side of the mouth of the container in the area of this opening.

Screw-caps of this type are typically used for the closing of bottles containing soft drinks infused with carbon dioxide. With the ring-shaped sealing lip the result aimed for is a reliable seal which still remains effective even when the cap top bulges outward under the internal pressure within the container. Thus, by way of example, a screw-cap has become known from Swiss Patent No. 607 702, in which the cap top merges into a bevelled-off sealing ring which presses against the outer side of the container mouth. On the inner side of the bevelled-off sealing ring there is affixed a ring-shaped sealing lip which is pulled over the container mouth like a collar when screwed on, and therefore exerts a supplementary sealing action. In the German Patent No. 26 01 771 there is described a screw-cap in which the ring-shaped sealing lip is affixed inclined toward the inner side, acting in conjunction with a recessed groove encircling the container mouth.

In all the known embodiment forms the inner diameter of the ring-shaped sealing lip on the unscrewed screw-cap is somewhat smaller than the outer diameter of the container mouth right from the start. This is done to ensure that the initial tension of the sealing lip will force it against the container mouth in every case. A disadvantage of this configuration, however, is inherent in the fact that the sealing lip has to be stretched outward when it is screwed on, which requires a correspondingly greater amount of torque during the screwing-on process. Added to that, the sealing lip could be damaged when being screwed onto containers with sharp mouth edges. The stretching of the sealing lip moreover has the result that, when the screw-cap is screwed on, the sealing lip is subjected to very high and lasting tension. As particularly described in German Patent No. 26 01 771, this tension is even more increased by the effects of the internal pressure on the cap top. This tension, however, can result in cracks in the material or even fatigue fractures which, to state the obvious, can lead to leakage at such spots or even to explosion-like blasting loose of the screw-cap.

It is therefore the aim of the invention to produce a screw-cap of the type described in the introduction which it is possible to screw effortlessly onto the container mouth with slight torque and without danger of damage to the sealing lip, and in which the sealing lip is not subjected to any excessive tension after the screw-cap is screwed on, without thereby adversely affecting its sealing function.

This aim is achieved as per the invention in that, prior to the screw-cap being screwed on, the inner diameter of the sealing lip is greater than the outer diameter of the container mouth, in that the cap top has a clamping device inserted into the container mouth for the concentric compression of the cap top when the screw-cap is put on, and in that at least the cap top is elastically constructed in such a way that the sealing lip can be pressed against the outer side of the container mouth by means of the compression of the cap top and by means of the reduction in the outer diameter of the cap top when the clamping device is inserted into the container mouth.

In this configuration it should be obvious that the ring-shaped sealing lip is not stretched during the screwing-on of the screw-cap. On the contrary, the sealing lip is pressed against the outer side of the container mouth during the course of the screwing-on process. This function is based on the surprising discovery that, given a suitable elasticity in the cap top, it is possible to bring about a contraction of the cap top without much difficulty by means of an appropriate clamping device, and that the sealing lip can be moved with the aid of this contraction. It is obvious that this type of an arrangement has substantial advantages vis-a-vis the known state of the art. First of all, the sealing lip is pressed against the container mouth without stress by means of a radial contraction movement during the course of the screwing-on process. Particularly where sharp-edged container mouths are involved this system prevents the scratching of the sealing lip as it is forced inward. Over and above that, a better definition of the contact pressure of the sealing lip is possible with the aid of the clamping device. The sealing lip is not overstretched right from the beginning but reaches the required contact pressure, just adequate to maintain a reliable sealing function, only after the screw-cap has been screwed on. Furthermore, tensions created by internal pressure, by this means, are not able to lead to any damage to the screw-cap. With the aid of the compressible sealing lip it is additionally possible for the first time to achieve a ring-shaped sealing section on the inner side of the sealing lip. With the conventional types of sealing lips all that could be achieved was merely a sealing line, since a planar sectional contact by the sealing lip was not possible.

The invention can be made particularly advantageous if the clamping device is a ring-shaped inner seal whose inner diameter is greater than the inner diameter of the container mouth and which makes a sealing contact along a sealing line on the inner side of the container mouth. In this manner the clamping device usefully performs the function of a supplementary seal. The upper rim of the mouth of the bottle is thus sealed off both inside and outside, which substantially improves the sealing effect.

A good sealing effect is achieved if the inner side-wall of the sealing lip is constructed approximately cylindrically. In this manner the inner side of the sealing lip makes a flat sectional contact with the outer side of the container mouth. In specific types of application, however, it is useful if the inner side-wall of the sealing lip is joined to the cap top in a tapered form approximately like a truncated cone in shape. By this means, changes in the position of the sealing lip when compressed can be taken into account ahead of time, so that the inner side-wall of the sealing lip will make a flat sectional contact with the container mouth once again after the screw-cap has been screwed on.

A supplementary sealing section can be achieved by arranging to have a concentric ring surface within the sealing lip as a stop to limit the screwing-on movement. A limitation of the screwing-on process is particularly important since, by this means, the contraction movement can also be restricted. In this way too strong a compression of the sealing lip is prevented. The upper edge of the container mouth is pressed against the ring surface, so that a supplementary sealing occurs.

A specially advantageous sealing effect is achieved if the lower edge of the sealing lip is arranged to be approximately at the same level as the sealing line. By this means the forces acting on the sealing line and on the sealing section of the sealing lip run approximately in the same plane, by which means a compression of the container rim is achieved.

The function of the clamping device can be improved by means of having it designed as an indentation of the cap top, whose sides facing the container mouth are tapered downward approximately in the shape of a truncated cone. By means of the indentation in the cap top the latter's outer rim section can, as should be obvious, be compressed more easily since, in the plane of the contractional movement, the cap top is indented in the centre. By means of the truncated-cone-shaped design of the indentation a leverage effect is achieved which, when the container mouth is forced against the truncated-cone-shaped side-walls, results in a compression of the outer rim section of the cap top. This type of design for the screw-cap is particularly of advantage in those cases where the screw-cap is made of a relatively rigid material, a material where the compression of the sealing lip having a disk-shaped cap top would only be possible by using a lot of force.

Especially good results with respect to the elasticity of the cap top are achieved if the screw-cap is made of polyethylene. With appropriate dimensioning of the screw-cap a compression of the sealing lip can be effected with this material without excessive use of force.

Figure 2:
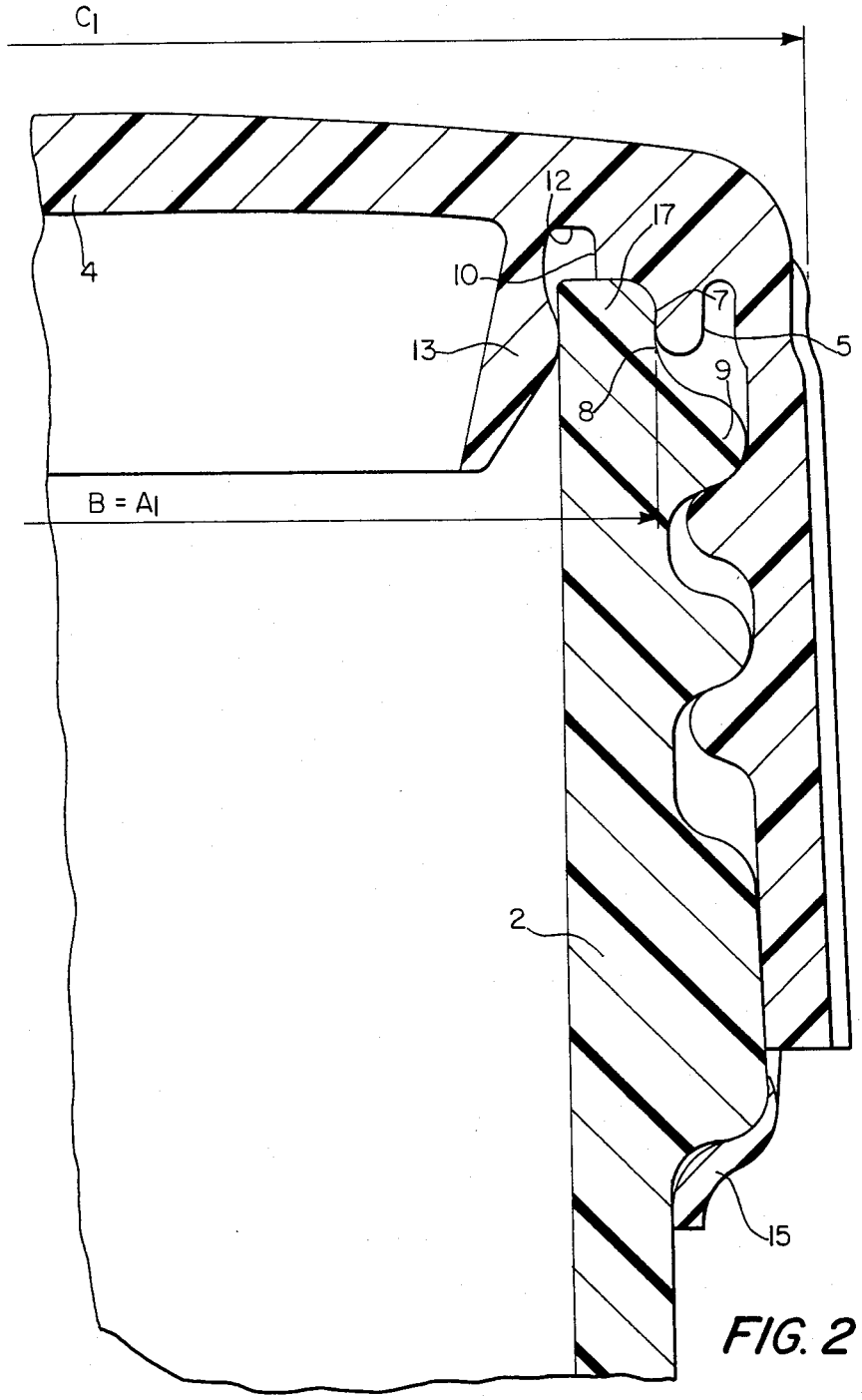
Figure 3:
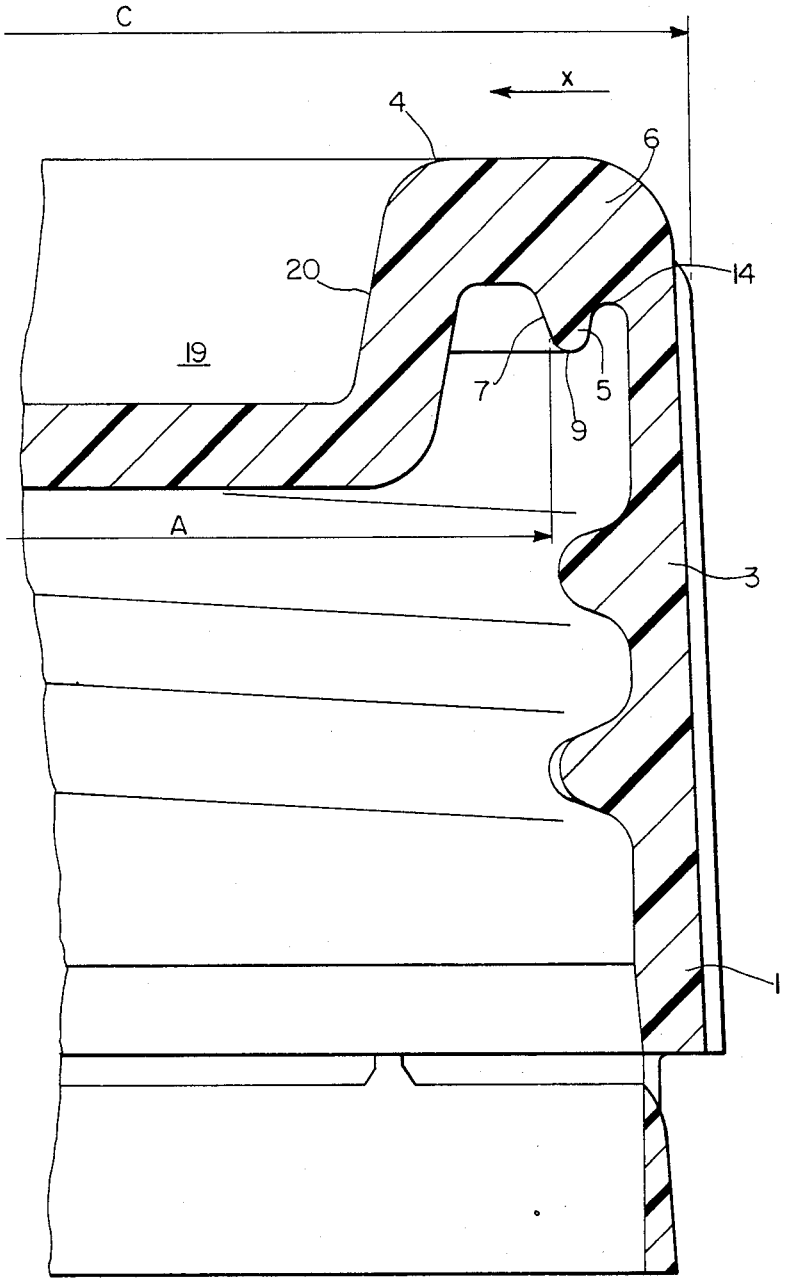

An embodiment example of the invention is illustrated in the drawings and will be described in greater detail below. The drawings show the following:

FIG. 1 - A partial cross-section of a screw-cap as per the invention, shown in greatly enlarged illustration FIG. 2 - The screw-cap as per FIG. 1 screwed onto a container mouth FIG. 3 - A modified embodiment example with an indented cap top.

As illustrated in FIG. 1, a screw-cap 1 consists of an approximately cylindrical cap side-wall 3 with internal threading 18 and a cap top 4. In the area of the junction point 6 between the cap top and the cap side-wall there is a sealing lip 5 affixed to the cap top. Immediately inside the sealing lip there is affixed a stop 10 to limit the screw-on movement. The ring-shaped stop merges into a radius 11 in the inner side-wall 7 of the sealing lip. Between the sealing lip 5 and the cap side-wall 3 there is an interspace 14, which corresponds in size approximately to the thickness of the sealing lip. In specific types of application the interspace 14 can also be omitted, so that the sealing lip 5 merges directly from the lower edge 9 into the outer wall and is therefore designed in the shape of a shoulder.

An inner seal 13, known as such, takes on the function of a clamping device for the compression of the sealing lip 5. The inner seal has an approximately convex outer configuration in cross-section with a sealing line 16 along which the inner seal makes contact with the inner wall of the container mouth. The sealing line 16 is located approximately on the same plane as the lower edge of the sealing lip 5. Between the inner seal 13 and the stop 10 there is located an undercut 12, in order to give a degree of flexibility to the inner seal as well.

As illustrated, the inner diameter A of the sealing lip 5 is greater than the outer diameter of the outer wall 8 (shown by a broken line) of the container mouth. By this means there is created a play clearance "a" between the container mouth and the sealing lip.

When the screw-cap is screwed on, the inner seal 13 is pressed together by the upper side of the container mouth 17. Since the cap top 4 has a certain amount of elasticity this also produces a contraction of the cap top, particularly in the outer area 6, in the direction of the arrow "X". By this means the play clearance "a" is eliminated and the sealing lip 5 makes sealing contact against the outer wall 8 of the container mouth. As shown in FIG. 2 this action also results in a measurable contraction of the outer diameter C of the cap side-wall 3. The original outer diameter C now has a reduced diameter C1, while the reduced inner diameter A1 of the sealing lip corresponds to the outer diameter B of the container mouth.

The cap top 4 bulges slightly outward because of the contraction movement, by which means the contact pressure of the sealing lip is strengthened even more.

The container mouth 2 may be made of either plastic, glass or some other material. The screw-cap 1 has on the bottom edge a security strip 15 which is intended to be shrink-fastened by means of heat-molding to a beading on the container mouth. The first time the screw-cap is unscrewed this security strip 15 is ripped apart.

In FIG. 3 a modified embodiment example is illustrated, in which the cap top 4 has an indentation 19. The side-wall 20 of the indentation is constructed in an approximately truncated cone shape, so that by this means there is formed an inclined contact surface for the container mouth. The side-wall 20 of the indentation 19 by this means creates a lever arm with which a contraction of the outer section 6 in the direction of the arrow "X" can be achieved in a particularly simple manner.

In the embodiment example as per FIG. 3 the inner wall 7 of the sealing lip 5 is also constructed in an approximately truncated cone shape, so that any kind of a position change of the sealing lip can be taken into account ahead of time. It goes without saying that the inner wall 7 of the sealing lip can also be adapted to whatever outer configuration the container mouth may have which, by way of example, may likewise be in the shape of a truncated cone. Obviously there are also other means possible that can be used as clamping devices to compress the cap top. Thus, one might for example attach a number of concentrically-arranged wedges to the cap top, whose tapered surfaces would run onto the inner edge of the container mouth and in this manner compress the cap top.

In an experiment with a standard-sized container mouth of the type 1716 of the Aluminium Company of America the following results were obtained: Dimensions prior to screwing on the cap:

| | |
|---|---|
| Inner diameter A of the sealing lip | 25.1 mm ± 0.1 |
| Outer diameter C of the screw-cap | 30.5 mm |
| Outer diameter B of the container mouth | 24.95 mm |
| Outer diameter of the inner seal | 22.6 mm ± 0.1 |
| Length of the sealing lip from the stop 10 to the lower edge 9 | 1.15 mm +0/−0.1 |
| Wall thickness of the cap top in the area of the undercut 12 | about 1.2 mm |

After screwing on the screw-cap with a torque of about 17 cm/kg an outer diameter C1 of 30.1 mm was measured on the screw-cap. The sealing, at an internal pressure of about 8 bar and an internal temperature of about 40° C. was still absolutely tight. A polyethylene plastic with the specification HDPE was used as material for the screw-cap.

I claim:

1. A screw-cap made of plastic material for closing the mouth of a container having a predetermined outer diameter, consisting of an approximately cylindrical cap side-wall with inner threading and a cap top, which is provided with a ring-shaped sealing lip to seal against the outer side of the mouth of the container in the area of the opening, characterized in that the inner diameter (A) of the sealing lip (5), before the screw-cap (1) is screwed on, is greater than the outer diameter (B) of the container mouth (2) against which it is to seal, in that the cap top (4) has a clamping device inserted into the container mouth for effecting radial contraction of the cap top when putting on the screw-cap, and in that at least the cap top is elastically constructed in such a way that the sealing lip is contracted inwardly and pressed against the outer side of the container mouth, as the clamping device is inserted into the container mouth, by means of the compression of the cap top and the radial contraction and reduction of its outer diameter.

2. A screw-cap as per claim 1, characterized in that the clamping device is a ring-shaped inner seal (13) whose outer diameter is greater than the inner diameter of the container mouth and which makes sealing contact with the inner side of the container mouth along a sealing line (16).

3. A screw-cap as per claim 2, characterized in that the inner wall of the sealing lip is constructed in approximately cylindrical form.

4. A screw-cap as per claim 2, characterized in that the inner wall of the sealing lip is tapered where it joins the cap top, approximately in the shape of a truncated cone.

5. A screw-cap as claimed in claim 2, characterized in that, on the inner part of the sealing lip there is affixed a concentric ring surface acting as a stop (10) to limit the screwing-on movement.

6. A screw-cap as claimed in claim 2, characterized in that the bottom edge (9) of the sealing lip is arranged to be at approximately the same level as the sealing line.

7. A screw-cap as per claim 1, characterized in that the clamping device is designed in the form of an indentation of the cap top, whose side facing the container mouth is tapered downward approximately in the shape of a truncated cone.

8. A screw-cap as claimed in claim 1 in combination with a container having an open-mouthed threaded neck with a circumferential sealing area on its outer side extending downwardly from the mouth, the outer diameter of the sealing area being less than the inner diameter of said sealing lip before the cap is screwed on.

* * * * *